US005486802A

United States Patent [19]

Leupold

[11] Patent Number: 5,486,802

[45] Date of Patent: Jan. 23, 1996

[54] SPHERICAL MAGNET STRUCTURE AND USE THEREOF IN SYNCHROTRON RADIATION SOURCE

[75] Inventor: Herbert A. Leupold, Eatontown, N.J.

[73] Assignee: The United States of America as represented by the Secretary of the Army, Washington, D.C.

[21] Appl. No.: 349,222

[22] Filed: Dec. 5, 1994

[51] Int. Cl.[6] ..... H01F 7/02

[52] U.S. Cl. ..... 335/306; 315/503; 335/210

[58] Field of Search ..... 335/210, 302, 335/306; 315/5.35, 500–505

[56] References Cited

U.S. PATENT DOCUMENTS

| | | | |
|---|---|---|---|
| 4,837,542 | 6/1989 | Leupold | 335/306 |
| 5,028,903 | 7/1991 | Aubert | 335/306 |
| 5,072,204 | 12/1991 | Leupold | 335/306 |
| 5,103,200 | 4/1992 | Leupold | 335/217 |
| 5,216,401 | 6/1993 | Leupold | 335/306 |
| 5,382,936 | 1/1995 | Leupold et al. | 335/306 |

*Primary Examiner*—Leo P. Picard
*Assistant Examiner*—Raymond M. Barrera
*Attorney, Agent, or Firm*—Michael Zelenka; John M. O'Meara

[57] ABSTRACT

An equatorial gap is disposed into a magnet structure of spherical configuration, about the periphery thereof. The magnet structure includes a spherical shell of one magnetic material and a core of another magnetic material disposed centrally therein, with the gap penetrating into the shell. A source of synchrotron radiation is derived by combining the magnet structure with an apparatus for introducing charge particles into the gap wherein a magnetic field influences the particles to travel in circular paths.

10 Claims, 1 Drawing Sheet

SPHERICAL MAGNET STRUCTURE AND USE THEREOF IN SYNCHROTRON RADIATION SOURCE

GOVERNMENT INTEREST

The invention described herein may be manufactured, used, and licensed by or for the United States Government for governmental purposes without payment to me of any royalties thereon.

BACKGROUND OF THE INVENTION

The present invention relates generally to spherical magnet structures and more particularly to such structures for use in synchrotron radiation sources.

Synchrotron radiation is generated by directing charged particles in a circular path. Magnet arrangements for generating synchrotron radiation are well known. However such arrangements include a plurality of separately mounted magnets and therefore, tend to be of cumbersome construction.

SUMMARY OF THE INVENTION

It is the general object of the present invention to provide a spherical magnet structure having a core within a spherical shell and an equatorial gap which penetrates thereinto about the periphery thereof.

It is a specific object of the present invention to incorporate the magnet structure of the general object into a synchrotron radiation source.

These and other objectives are accomplished in accordance with the present invention by modifying the spherical magnet of U.S. Pat. No. 4,837,542 to derive a magnet structure having a core and an equatorial gap. The core is of magnetic material and serves to enhance the magnetic field density within the gap. A synchrotron radiation source is derived by directing charged particles into the gap of the magnet structure where they are influenced by the magnetic field to travel a circular path, so that synchrotron radiation results from those particles and is emitted from the gap of the magnet structure.

The scope of the present invention is only limited by the appended claims for which support is predicated on the preferred embodiments hereinafter set forth in the following description and the attached drawings wherein like reference characters relate to like parts throughout the figures.

DESCRIPTION OF THE PREFERRED EMBODIMENTS

Figure 1:
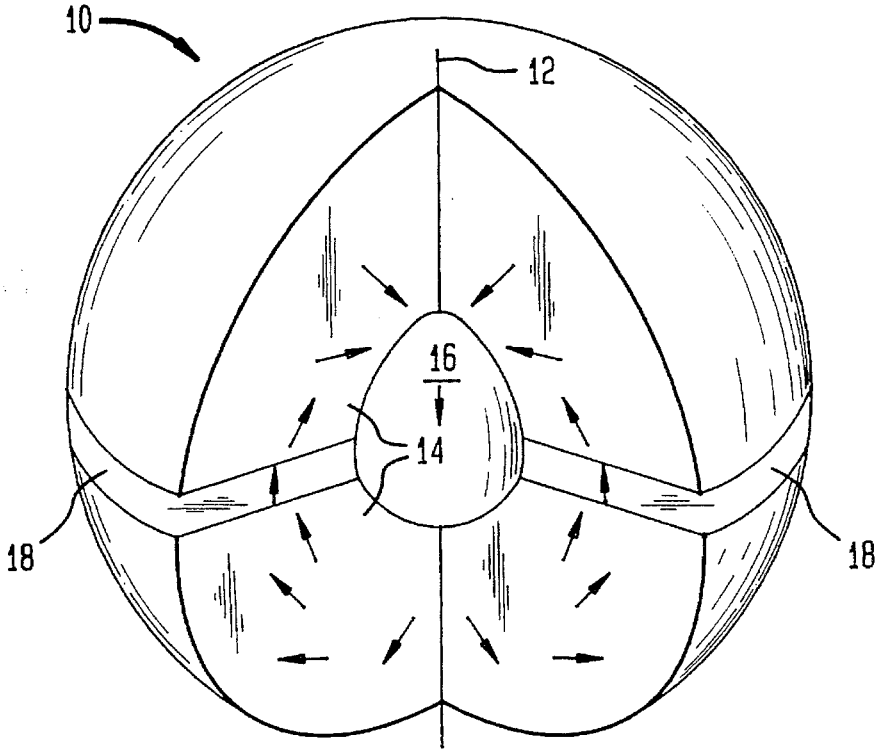
FIG. 1 is a cutaway, isometric view regarding the preferred magnet structure embodiment of the invention.

Of fundamental importance to the present invention is a magnet structure 10 of spherical configuration that has poles through which a magnetic axis 12 passes, as shown in FIG. 1. Magnet structure 10 includes a shell 14 with a solid core 16 centrally disposed therein. The shell 14 is fabricated of one magnetic material of the active or permanently magnetic type, while the core 16 is fabricated of a second magnetic material of either the active type or the passive type such as iron. Although the iron core 16 is of spherical configuration in FIG. 1, other configurations thereof are possible. An equatorial gap 18 penetrates into the structure 10 about the periphery thereof.

Although it is not yet practical to fabricate or magnetize the shell 14 in single piece construction, segmented construction thereof in accordance with the concepts disclosed in U.S. Pat. No. 5,337,472 can be readily accomplished. Regardless of its construction technique, shell 14 is magnetized to sustain a magnetic field across the gap 18 in a direction parallel to the magnetic axis 12. Therefore, the introduction of charged particles into the gap 18 will result in those particles being influenced by the magnetic field in the gap 18 to travel in a circular path around the magnetic axis 12. As is well known, charged particles traveling in a circular path generate synchrotron radiation and consequently, the magnet structure 10 of this invention can be utilized in implementing a source of such radiation.

Figure 2:
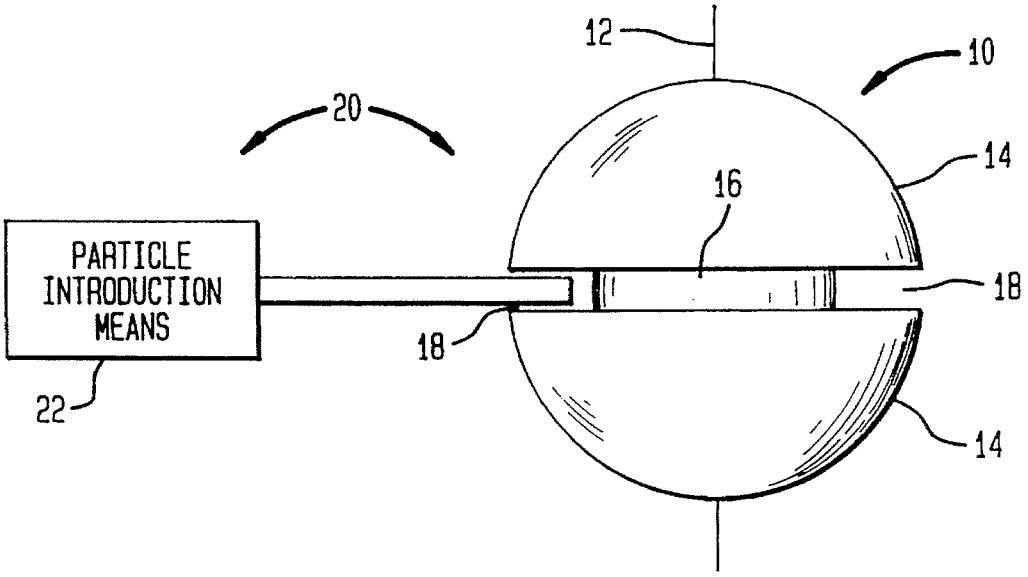
FIG. 2 is a block diagram and plane view combination of a synchrotron radiation source in accordance with the invention.

A synchrotron radiation source 20 with the magnet structure 10 of the invention incorporated therein, is illustrated in FIG. 2. Means 22 is disposed in proximity to the magnet structure 10 for introducing charged particles to a plane oriented perpendicularly across the magnetic axis 12 within the gap 18 thereof. A conventional electron gun could serve as the particle introduction means 22 and as explained above, such particles travel a circular path about the magnetic axis 12 in that plane. Therefore, synchrotron radiation is generated by those particles and is emitted from the magnet structure 10 through the gap 18.

Those skilled in the art will appreciate without any further explanation that within the concept of this invention, many modifications and variations are possible to the above disclosed embodiments of spherical magnet structures. Consequently, it should be understood that all such modifications and variations fall within the scope of the following claims.

What I claim is:

1. A magnet structure, comprising:

a spherical shell fabricated of active magnetic material with an equatorial gap disposed thereinto about the entire periphery thereof and having a solid core fabricated of a second magnetic material centrally disposed therein, the shell being magnetized to sustain a magnetic field across the gap in a direction parallel with a magnetic axis which extends between poles thereon and through the core.

2. The magnet structure of claim 1 wherein the core is spherical.

3. The magnet structure of claim 1 wherein the gap extends within the shell to the core.

4. The magnet structure of claim 1 wherein the second magnetic material of the core is an active type other than that from which the shell is fabricated.

5. The magnet structure of claim 1 wherein the second magnetic material of the core is a passive type.

6. A synchrotron radiation source, comprising:

a spherical shell fabricated of active magnetic material with an equatorial gap disposed thereinto about the periphery thereof and having a solid core fabricated of a second magnetic material centrally disposed therein, the shell being magnetized to sustain a magnetic field across the gap in a direction parallel with a magnetic axis which extends between poles thereon and through the core; and means for introducing charged particles within the gap to a plane oriented perpendicularly across the magnetic axis, wherein such particles are influenced by the magnetic field to travel in a circular path around the magnetic axis and thereby generate synchrotron radiation which is emitted through the gap.

7. The radiation source of claim 6 wherein the core is spherical.

8. The radiation source of claim 6 wherein the gap extends within the shell to the core.

9. The radiation source of claim 6 wherein the second magnetic material of the core is an active type other than that from which the shell is fabricated.

10. The radiation source of claim 6 wherein the second magnetic material of the core is a passive type.

* * * * *